US012514379B2

(12) United States Patent
Hill et al.

(10) Patent No.: US 12,514,379 B2
(45) Date of Patent: Jan. 6, 2026

(54) BED SYSTEM WITH INTEGRATED DOCK FOR REMOTE AND READING LIGHT

(71) Applicant: Sleep Number Corporation, Minneapolis, MN (US)

(72) Inventors: Carli Hill, Oxnard, CA (US); Joseph Ermalovich, Santa Barbara, CA (US); Antony Kirk, Minnetonka, MN (US); Lori MacLachlan, Minneapolis, MN (US)

(73) Assignee: Sleep Number Corporation, Minneapolis, MN (US)

( * ) Notice: Subject to any disclaimer, the term of this patent is extended or adjusted under 35 U.S.C. 154(b) by 388 days.

(21) Appl. No.: 18/087,078

(22) Filed: Dec. 22, 2022

(65) Prior Publication Data

US 2023/0210275 A1 Jul. 6, 2023

Related U.S. Application Data

(60) Provisional application No. 63/295,189, filed on Dec. 30, 2021.

(51) Int. Cl.
*A47C 31/00* (2006.01)
*A47C 21/00* (2006.01)

(52) U.S. Cl.
CPC ..... *A47C 31/008* (2013.01); *A47C 21/003* (2013.01)

(58) Field of Classification Search
CPC ..... A47C 21/00; A47C 21/003; A47C 31/008; A47C 19/022
See application file for complete search history.

(56) References Cited

U.S. PATENT DOCUMENTS 5,255,403 A * 10/1993 Ortiz ..... A47C 20/041 5/503.1
7,127,075 B2 * 10/2006 Park ..... A47C 27/081 381/151

(Continued)

FOREIGN PATENT DOCUMENTS

KR 2009-0010582 10/2009
TW M 519922 4/2016

(Continued)

OTHER PUBLICATIONS

U.S. Appl. No. 16/719,177, filed Dec. 18, 2019, Nunn et al..

(Continued)

*Primary Examiner* — George Sun
(74) *Attorney, Agent, or Firm* — Fish & Richardson P.C.

(57) ABSTRACT

Described are bed systems including a docking structure defining a first recess and a second recess, a remote to dock into the first recess, and a light integrated into the second recess. The light can move between a docked configuration and an extended configuration. The light can extend out from the second recess and rotate when in the extended configuration. The second recess is aligned with and positioned above the first recess. The first recess has a same width as the second recess, and the first recess has a length substantially longer than the second recess. The remote is oblong and curved at opposite ends. A distal end of the light is oblong-shaped, and the light includes at least one button along a lateral side of the light for turning the light on and off.

20 Claims, 10 Drawing Sheets

(56) References Cited

U.S. PATENT DOCUMENTS 7,444,705 B2 * 11/2008 Chang ..... A47C 19/022 5/904
8,444,558 B2 5/2013 Young et al.
8,672,853 B2 3/2014 Young
8,984,687 B2 3/2015 Stusynski et al.
9,370,457 B2 6/2016 Nunn et al.
9,392,879 B2 7/2016 Nunn et al.
9,445,751 B2 9/2016 Young et al.
9,504,416 B2 11/2016 Young et al.
9,510,688 B2 12/2016 Nunn et al.
9,635,953 B2 5/2017 Nunn et al.
9,770,114 B2 9/2017 Brosnan et al.
9,844,275 B2 12/2017 Nunn et al.
9,931,085 B2 4/2018 Young et al.
9,970,651 B2 5/2018 Wang et al.
10,058,467 B2 8/2018 Stusynski et al.
10,092,242 B2 10/2018 Nunn et al.
10,149,549 B2 12/2018 Erko et al.
10,182,661 B2 1/2019 Nunn et al.
10,201,234 B2 2/2019 Nunn et al.
10,226,133 B2 * 3/2019 Katz ..... H04R 1/025
10,251,490 B2 4/2019 Nunn et al.
10,342,358 B1 7/2019 Palashewski et al.
10,441,086 B2 10/2019 Nunn et al.
10,441,087 B2 10/2019 Karschnik et al.
10,448,749 B2 10/2019 Palashewski et al.
10,492,969 B2 12/2019 Stusynski et al.
10,632,032 B1 4/2020 Stusynski et al.
10,646,050 B2 5/2020 Nunn et al.
10,674,832 B2 6/2020 Brosnan et al.
10,716,512 B2 7/2020 Erko et al.
10,729,255 B2 8/2020 Erko et al.
10,736,432 B2 8/2020 Brosnan et al.
10,750,875 B2 8/2020 Palashewski et al.
10,827,846 B2 11/2020 Karschnik et al.
10,881,219 B2 1/2021 Nunn et al.
10,957,335 B2 3/2021 Demirli et al.
10,959,535 B2 3/2021 Karschnik et al.
D916,745 S 4/2021 Stusynski et al.
10,980,351 B2 4/2021 Nunn et al.
11,096,849 B2 8/2021 Stusynski et al.
11,122,909 B2 9/2021 Palashewski et al.
11,160,683 B2 11/2021 Nunn et al.
11,206,929 B2 12/2021 Palashewski et al.
D954,725 S 6/2022 Stusynski et al.
11,470,980 B2 * 10/2022 Schulte ..... A47C 31/008
D968,436 S 11/2022 Stusynski et al.
D975,121 S 1/2023 Stusynski et al.
11,701,060 B2 * 7/2023 Murai ..... A61G 7/05 700/28
2008/0077020 A1 3/2008 Young et al.
2008/0101058 A1 5/2008 Smith
2008/0224861 A1 * 9/2008 McNeely ..... H04L 5/1461 340/540
2009/0064415 A1 * 3/2009 Payne ..... A47C 21/08 5/658
2009/0177327 A1 * 7/2009 Turner ..... A47C 21/003 5/616
2009/0211025 A1 * 8/2009 Joyce ..... A47G 9/0246 5/497
2010/0170043 A1 7/2010 Young et al.
2011/0138534 A1 * 6/2011 Kozel ..... A47C 19/00 5/499
2011/0144455 A1 6/2011 Young et al.
2013/0289770 A1 * 10/2013 Rawls-Meehan .... A47C 20/041 700/275
2014/0265752 A1 * 9/2014 Caine ..... A47B 81/061 312/7.2
2014/0277822 A1 9/2014 Nunn et al.
2016/0015184 A1 1/2016 Nunn et al.
2016/0286965 A1 * 10/2016 Koch ..... A47C 7/748
2016/0367039 A1 12/2016 Young et al.
2017/0065220 A1 3/2017 Young et al.
2017/0128001 A1 5/2017 Torre et al.
2017/0143269 A1 5/2017 Young et al.
2017/0245648 A1 * 8/2017 Charlebois ..... F21V 33/0012
2017/0360210 A1 * 12/2017 Risdon ..... A47C 19/022
2019/0053761 A1 2/2019 Torre et al.
2019/0069840 A1 3/2019 Young et al.
2019/0200777 A1 7/2019 Demirli et al.
2019/0201265 A1 7/2019 Sayadi et al.
2019/0201266 A1 7/2019 Sayadi et al.
2019/0201267 A1 7/2019 Demirli et al.
2019/0201268 A1 7/2019 Sayadi et al.
2019/0201270 A1 7/2019 Sayadi et al.
2019/0201271 A1 7/2019 Grey et al.
2019/0328146 A1 10/2019 Palashewski et al.
2019/0328147 A1 10/2019 Palashewski et al.
2020/0315367 A1 10/2020 Demirli et al.
2020/0336010 A1 10/2020 Holmvik et al.
2020/0337470 A1 10/2020 Sayadi et al.
2020/0359807 A1 11/2020 Brosnan et al.
2020/0367663 A1 11/2020 Nunn et al.
2020/0405070 A1 12/2020 Palashewski et al.
2020/0405240 A1 12/2020 Palashewski et al.
2021/0000261 A1 1/2021 Erko et al.
2021/0034989 A1 2/2021 Palashewski et al.
2021/0045541 A1 2/2021 Nunn et al.
2021/0068552 A1 3/2021 Palashewski et al.
2021/0112992 A1 4/2021 Nunn et al.
2021/0267380 A1 9/2021 Stusynski
2021/0282570 A1 9/2021 Karschnik et al.
2021/0289947 A1 9/2021 Karschnik et al.
2021/0314405 A1 10/2021 Demirli et al.
2021/0346218 A1 11/2021 Stusynski et al.
2021/0386209 A1 * 12/2021 Grutta ..... A47C 31/008
2022/0000273 A1 1/2022 Palashewski et al.
2022/0000654 A1 1/2022 Nunn et al.
2022/0225786 A1 7/2022 Palashewski et al.
2022/0265059 A1 8/2022 Palashewski et al.
2022/0305231 A1 9/2022 Stusynski et al.
2022/0346565 A1 11/2022 Karschnik et al.
2022/0354431 A1 11/2022 Molina et al.
2022/0386947 A1 12/2022 Molina et al.
2022/0395233 A1 12/2022 Siyahjani et al.
2023/0018558 A1 1/2023 Demirli et al.
2023/0035257 A1 2/2023 Karschnik et al.
2023/0037482 A1 2/2023 Demirli et al.
2023/0054736 A1 2/2023 Holmvik et al.
2023/0063373 A1 3/2023 Young et al.
2023/0371702 A1 * 11/2023 Atterbury ..... A47C 21/003

FOREIGN PATENT DOCUMENTS

WO WO 2017/103733 6/2017
WO WO 2021/146421 7/2021
WO WO 2021/257612 12/2021

OTHER PUBLICATIONS

U.S. Appl. No. 17/523,349, filed Nov. 10, 2021, Dixon et al.
U.S. Appl. No. 17/745,508, filed May 16, 2022, Nunn et al.
U.S. Appl. No. 17/984,752, filed Nov. 10, 2022, Karschnik et al.
U.S. Appl. No. 17/986,351, filed Nov. 14, 2022, Nunn et al.
U.S. Appl. No. 18/075,913, filed Dec. 6, 2022, Johnston et al.
U.S. Appl. No. 18/084,944, filed Dec. 20, 2022, Molina.
U.S. Appl. No. 18/086,003, filed Dec. 21, 2022, Kirk et al.
U.S. Appl. No. 18/086,104, filed Dec. 21, 2022, Hill et al.
U.S. Appl. No. 18/087,078, filed Dec. 22, 2022, Hill et al.
U.S. Appl. No. 18/087,973, filed Dec. 23, 2022, Hill et al.
U.S. Appl. No. 18/091,713, filed Dec. 30, 2022, MacLachlan et al.
U.S. Appl. No. 18/105,468, filed Feb. 3, 2023, Sayadi et al.
U.S. Appl. No. 29/814,835, filed Nov. 9, 2021, Dixon et al.
U.S. Appl. No. 29/837,293, filed May 4, 2022, Stusynski et al.
U.S. Appl. No. 29/881,955, filed Jan. 9, 2023, Stusynski et al.
International Preliminary Report on Patentability in International Appln. No. PCT/US2022/053804, mailed on Jun. 20, 2024, 12 pages.

(56) References Cited

OTHER PUBLICATIONS

International Search Report and Written Opinion in International Appln. No. PCT/US2022/053804, mailed on Jun. 30, 2023, 20 pages.

* cited by examiner

BED SYSTEM WITH INTEGRATED DOCK FOR REMOTE AND READING LIGHT

INCORPORATION BY REFERENCE

This application claims priority to U.S. Provisional Application Ser. No. 63/295,189, filed on Dec. 30, 2021, the disclosure of which is incorporated by reference in its entirety.

TECHNICAL FIELD

This document describes devices, systems, and methods generally related to a bed system with an integrated docking portion for a remote and/or light.

BACKGROUND

In general, a bed is a piece of furniture used as a location to sleep or relax. Many modern beds include a soft mattress on a bed frame. The mattress may include springs, foam material, and/or an air chamber to support the weight of one or more occupants.

SUMMARY

The document generally relates to a bed system having an integrated docking portion for a remote and/or light. More specifically, the bed system can include a headboard with left and right wings that are opposite each other. Each of the left and right wings can include an integrated docking portion that receive a remote. The remote can be used to control components of the bed system. For example, in a bed that is intended for two sleepers, a first remote can be used to control components of a left side of the bed and a second remote can be used to control components of a right side of the bed. Accordingly, the first remote can be retained in a docking portion in the left wing and the second remote can be retained in a docking portion in the right wing. The docking portions can be positioned in a location in the left and right wings that is easy to ready by users of the bed system, regardless of a position of the users while in the bed (e.g., laying flat, sitting up, or in any other position).

Each of the left and right wings can also include integrated docking portions that house individual lights. The lights can be reading lights. The lights can fold flush into the docking portions. A user can pull up on a light so that the light extends out and over a portion of the bed. The user can then adjust the light by rotating the light in any desired direction and/or toggling between colors and intensity of the emitted light. The light can provide preferred lighting whether the user is reading, working, and/or watching TV in bed.

The same docking portion can house both a remote and a light on each of the left and right wings. The light can be positioned above the remote in the docking portion. In some implementations, the light and remote can have independent docking portions. The light docking portion can be positioned above the remote docking portion. The remote can click into a recess of the docking portion, making it easy and quick to remove from and put into the docking portion. A back of the remote can also include a magnet that is attracted to a magnet in the recess of the docking portion, thereby releasably maintaining the remote in the docking portion. In some implementations, the docking portion may include an induction charger for purposes of charging the remote when placed in the docking portion.

One or more embodiments described herein can include a system including: a bed structure having a remote docking portion, and a remote that can be configured to dock into a recess of the remote docking portion.

In some implementations, the embodiments described herein can optionally include one or more of the following features. For example, the system can also include a mattress. The bed structure can be a headboard, the headboard can include first and second wings that can extend a distance from opposite lateral edges of the headboard. The remote docking portion can be recessed into at least one of the first and second wings. For example, the remote docking portion can be inset into at least one of the first and second wings at a distance of 25-80 mm from a lateral edge of the at least one of the first and second wings and a height of 25-80 mm from a top portion of the at least one of the first and second wings.

In some embodiments, the remote docking portion can include a wireless charger and a transmitter for inductively charging the remote when the remote is docked into the recess of the remote docking station. Sometimes, the remote docking portion can include an induction charger for wirelessly charging the remote when the remote is docked into the recess of the remote docking station.

In some embodiments, the remote can include a first magnet integrated into a back portion of the remote, the recess of the remote docking portion can include a second magnet, and docking the remote into the recess of the remote docking portion can cause the first magnet to be attracted to the second magnet to maintain the remote in the recess of the remote docking portion. The recess of the remote docking portion can be spring-loaded.

In some embodiments, the system can further include a light integrated into a second recess in the remote docking portion. The light can be configured to extend out from the second recess. The light can be rotatable when extended out from the second recess. The second recess can be positioned a distance of 25-80 mm above the recess for the remote.

In some embodiments, the system can include a light docking portion integrated into at least one of the first and second wings, and an extendable light positioned inside the light docking station. The light docking portion can be separate from the remote docking portion. The light docking portion can be aligned with and positioned above the remote docking portion. The light docking portion can be positioned 25-80 mm above the remote docking portion. Moreover, the light docking portion can have a same width as the remote docking portion. Sometimes, the light docking portion can be a height of 25-80 mm from a top portion of the at least one first and second wings. In some embodiments, the light docking portion can be a distance of 25-80 mm from a lateral edge of the at least one first and second wings. The light docking portion can be integrated with the remote docking portion in a singular dock.

As another example, the remote can be oblong and curved at opposite ends. An outer periphery of the remote can be substantially the same as an inner periphery of the recess of the remote docking portion. A distal end of the light can be oblong-shaped. An outer periphery of the light can be substantially the same as an inner periphery of the second recess of the remote docking portion. Moreover, the remote docking portion can be inset into at least one of the first and second wings at a distance closer to a lateral edge of the at least one of the first and second wings than a front side of the headboard and a height closer to a top portion of the at least one of the first and second wings than a bottom portion of the at least one of the first and second wings.

One or more embodiments described herein can include a bed system having a bed structure having a remote charging portion, and a remote configured to communicate with one or more electrical systems of the bed system to operate the one or more electrical systems. The remote can be configured to be positioned adjacent to the remote charging portion to inductively charge the remote when the remote is positioned adjacent to the remote charging portion.

In some implementations, the embodiments described herein can optionally include one or more of the following features. For example, the remote charging portion can include one or more wireless charging coils that can be configured to inductively charge the remote. In some implementations, the remote charging portion can include a wireless charger and a transmitter configured to inductively charge the remote.

In some embodiments, the remote charging portion can include a recess having a first magnet, the remote can include a second magnet integrated into a back portion of the remote, and positioning the remote adjacent to the remote docking portion can include docking the remote in the recess of the remote charging portion such that the first magnet can be attracted to the second magnet to maintain the remote in the recess of the remote docking portion. The recess of the remote docking portion can be spring-loaded. In some embodiments, the bed structure can include a headboard having first and second wings that extend a distance from opposite lateral edges of the headboard, and the remote docking portion can be recessed into at least one of the first and second wings.

One or more embodiments described herein can include a bed system having a docking structure defining a first recess and a second recess, a remote configured to dock into the first recess of the docking structure, and a light integrated into the second recess of the docking structure. The light can be configured to move between a docked configuration and an extended configuration. The light can extend out from the second recess of the docking structure in the extended configuration.

In some implementations, the embodiments described herein can optionally include one or more of the following features. For example, the light can be rotatable when in the extended configuration. As another example, the second recess can be positioned a distance of 25-80 mm above the first recess. The first recess of the docking structure can be separate from the second recess of the docking structure. The second recess can be aligned with and positioned above the first recess. The first recess can have a same width as the second recess. The first recess can have a length that is substantially longer than the second recess. The second recess can have a distance closer to a top portion of the bed structure than a distance from the first recess to the top portion of the bed structure. The first recess can have a same distance from a lateral edge of the bed structure as the second recess from the lateral edge of the bed structure. The first and second recesses can be closer to a lateral edge of the bed structure than an opposite lateral edge of the bed structure.

Additionally, the remote can be oblong and curved at opposite ends. An outer periphery of the remote can be substantially the same as an inner periphery of the first recess. A distal end of the light can be oblong-shaped. An outer periphery of the light can be substantially the same as an inner periphery of the second recess.

One or more embodiments described herein can include a system including: a bed structure having a remote docking portion, and a remote that can be configured to dock into a recess of the remote docking portion, where the bed structure can be a headboard that may include first and second wings that extend a distance from opposite lateral edges of the headboard.

The system can optionally include one or more of the abovementioned features and/or one or more of the following features. For example, the system can also include a light integrated into a second recess in the remote docking portion. The light can be configured to (i) extend out from the second recess and (2) rotate when extended out from the second recess. The second recess can be positioned above and can be aligned with the recess for the remote. The light can include a button along an edge of the light to turn the light on and off. A distal end of the light can be oblong-shaped and an outer periphery of the light can be substantially the same as an inner periphery of the second recess.

One or more embodiments described herein can include a bed system having: a headboard structure including: a main headboard portion, a left wing attached to a first lateral edge of the main headboard portion, and a right wing attached to a second lateral edge of the main headboard portion, a first docking structure defining a first recess and a second recess, the first docking structure being integrated into the left wing of the headboard structure, a second docking structure defining a first recess and a second recess, the second docking structure being integrated into the right wing of the headboard structure, a first light integrated into the second recess of the first docking structure, and a second light integrated into the second recess of the second docking structure, the first and second lights each being configured to move between a docked configuration and an extended configuration.

The bed system can optionally include one or more of the abovementioned features and/or one or more of the following features. For example, the bed system can include a first remote that can be configured to dock into the first recess of the first docking structure and a second remote that can be configured to dock into the first recess of the second docking structure. In some implementations, the first docking structure can be removable from the left wing and replaceable, and the second docking structure can be removable from the right wing and replaceable.

The devices, system, and techniques described herein may provide one or more of the following advantages. For example, the disclosed techniques provide for a convenient location of the docking portion on each of the left and right wings, which makes it easy for any user to reach the remote and/or light regardless of their position on the bed. Moreover, the docking portion is in a convenient location so that the users do not misplace the remotes. The docking portions further have a nonobtrusive design in which the docking portion, light, and remote are flush with the headboard wings, making such components in combination with the headboard aesthetically pleasing.

Similarly, the individual lights can be adjusted in color, intensity, and rotation in the docking portion to provide each user with preferred lighting regardless of the user's activity in the bed system. The individual lights can eliminate a need for bedside lamps, which can result in decluttering nightstands and making outlets or other power sources near and around the bed system in a sleep environment available to power other nightstand devices and the bed system.

Moreover, a remote can click in and out of the recess of the docking portion, making it easy and quick for any user to access the remote. In some implementations, the remote can also be inductively charged while in the docking portion. The remote can charge whenever placed inside the docking portion and the users of the bed system may not be required to switch out and replace batteries whenever the remotes are no longer working. This feature is beneficial to all types of users, especially a discrete aging population of users.

As another example, the bed system, such as the headboard and the docking portions, can have a strong and durable design, engineered using high quality textiles, fine hardwoods, durable leather, plastics, and other materials that make the bed system sturdy. The bed system can also have accented tailoring and layering of materials to provide an aesthetically pleasing appearance. For example, the docking portions, lights, and remotes can be made with materials that blend in with an upholstery material of the headboard wings. This provides an aesthetically pleasing appearance of the bed system and makes for nonobtrusive inclusion of the docking portions, lights, and remotes in the headboard wings.

Furthermore, while designed to support sleep needs for users of any age, the disclosed features and techniques of the bed system can also satisfy needs of a discrete aging population. Thus, the disclosed techniques can provide unique and dynamic abilities to adapt to any user of the bed system, no matter their needs.

The details of one or more implementations are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

This document generally relates to a bed system having integrated docking portions for remotes and/or lights. The bed system includes a headboard having left and right wings opposite each other. Each of the wings includes a docking portion. The docking portion can be positioned flush against the wing and can house a light, such as a reading light and/or a remote. A user of the bed system can extend the reading light out of the docking portion and adjust the reading light color, intensity, and rotation to meet the user's needs. Moreover, the remote can easily click into and out of the docking portion. The docking portion can be conveniently located on each wing of the headboard so that both the reading light and the remote can be easily accessed by the user in various positions while in the bed system.

Figure 1:
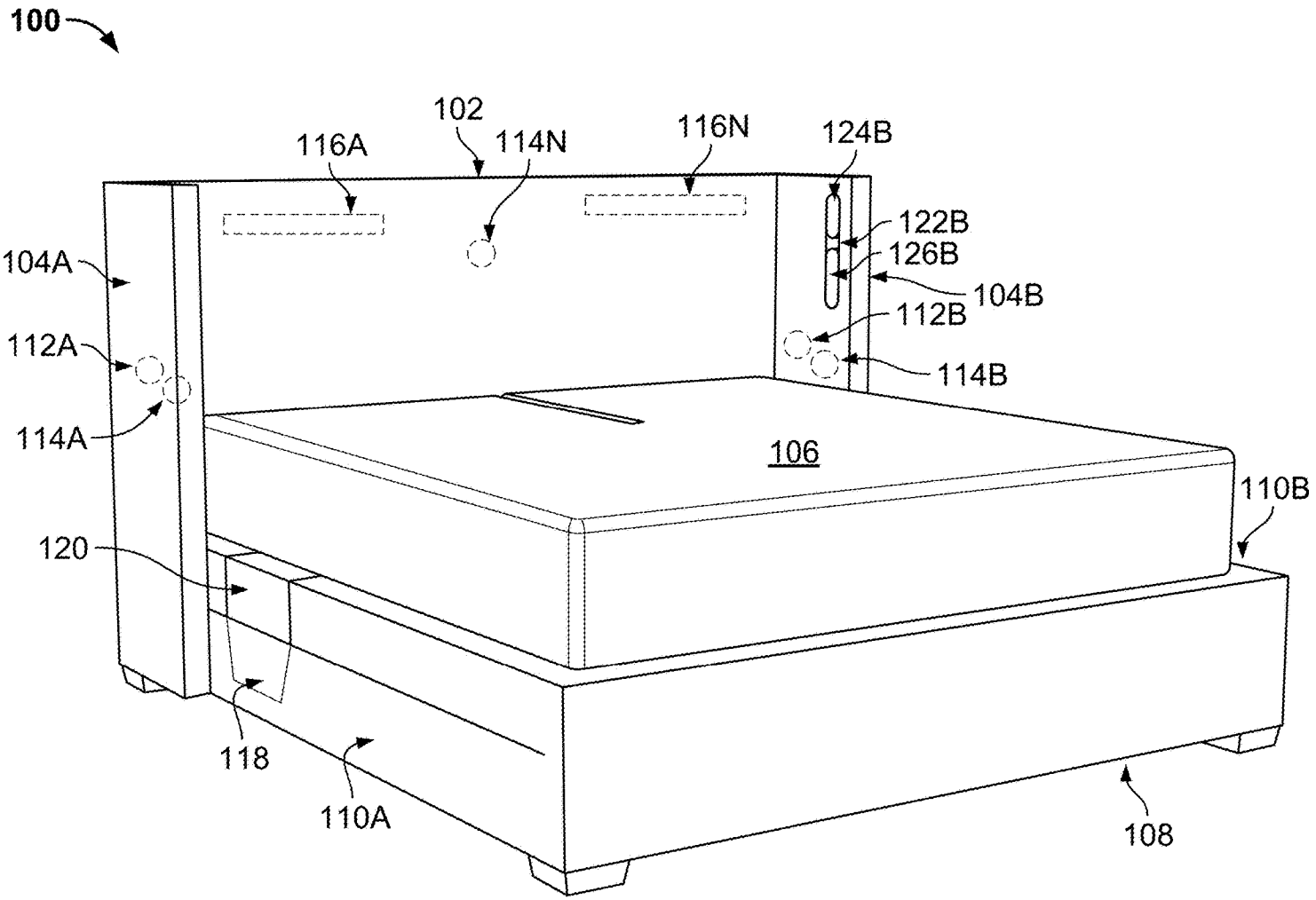
FIG. 1 depicts an example bed system.

Referring to the figures, FIG. 1 depicts an example bed system 100. The bed system 100 can include features that provide an improved sleep experience for a user of the bed system, including users having different age, conditions, demographics, and/or preferences.

The bed system 100 can include a headboard 102, foundation 108, and mattress 106. The mattress 106 can be sized for one user, such as a twin mattress. The mattress 106 can also be sized for two users, such as a full, queen, king, and/or California king mattress. As illustrated in FIG. 1, the mattress 106 can be a king mattress having a split top portion and a joined bottom portion. The mattress 106 can be an air mattress or other suitable mattress. The mattress 106 can also be articulable or stationary.

The headboard 102 can include a main headboard portion 201 and wings 104A and 104B. The wings 104A and 104B can extend a length along lateral edges of the mattress 106. In some implementations, the length can be 5 to 20 inches. In some implementations, the length can be 13 inches. For example, the wings 104A and 104B can extend to a length along the lateral edges of the mattress 106 that includes a head portion of the mattress 106 where the user may place their head on a pillow. As a result, the wings 104A and 104B can act as a barrier to some noises that may exist in a surrounding sleep environment.

The headboard 102 can include features for improving sleep experiences of the user of the bed system 100. For example, the headboard 102 can include speakers 112A and 112B, microphones 114A-N, lights 116A-N, docks 122A and 122B, reading lights 124A and 124B, and remotes 126A and 126B. The speakers 112A and 112B can be integrated into the wings 104A and 104B, respectively. The speakers 112A and 112B can be configured to play white and/or pink noise to reduce and/or cancel noise in the surrounding sleep environment. The user can connect one or more user devices (e.g. mobile phone, tablet, PC, or other computer) or another audio input to the speakers 112A and 112B (e.g., Bluetooth connection) to control audio that is played through the speakers 112A and 112B.

The microphones 114A and 114B can be integrated into the wings 104A and 104B, respectively. Additional microphones can also be integrated into other portions of the bed system 100. For example, the microphone 114N can be integrated into a midpoint of the headboard 102. Additional microphones can be integrated into the headboard 102 for each respective user/side of the mattress 106. The microphones 114A-N can be configured to detect noise in the surrounding sleep environment (such as snore or breathing sounds of one or both users, external noises, etc.). Based on the detected noise, the bed system 100 (e.g., a bed controller, such as controller 500 in FIG. 5) can generate an inverse sound wave to play through the speakers 112A and 112B to reduce and/or cancel the detected noise. As a result, the user of the bed system 100 can experience improved sleep quality undisturbed by noises in the surrounding sleep environment (e.g., snore or breathing sounds of one or both users, external noises, etc.).

The lights 116A-N can be integrated into a back portion of the headboard 102. The lights 116A-N, for example, can be recessed into the back portion of the headboard 102 and configured to provide ambient lighting that supports the user's circadian rhythm with wake and sleep routines.

The docks 122A and 122B can be integrated into the wings 104A and 104B, respectively. The docks 122A and 112B can house components such as the reading lights 124A and 124B, respectively, and the remotes 126A and 126B, respectively. These components can be kept in easy to access locations. In some embodiments, the user of the bed system 100 can access either of the reading lights 124A and 124B and/or the remotes 126A and 126B regardless of whether the user is laying down, sitting up, or otherwise inclined on the mattress 106. The reading lights 124A and 124B can extend out from the respective docks 122A and 122B and be tilted in a desired direction of the user. The user can also adjust the reading lights 124A and 124B color and intensity based on their particular needs and preferences. The remotes 126A and 126B can be used by the user to adjust their respective side of the bed system 100. For example, the remotes 126A and 126B can be used to adjust audio (e.g., volume level, turning audio on or off, setting a timer to automatically turn off the audio, etc.) that is played through the speakers 112A and 112B.

The foundation 108 includes side rails 110A and 110B. Pockets 118A and 118B (pocket 118B is not depicted in FIG. 1) can be integrated into the side rails 110A and 110B, respectively. The pockets 118A and 118B can be storage pockets for holding objects including but not limited to mobile devices (e.g., laptops, tablets, mobile phones, smart phones, etc.), books, magazines, and other items. The pockets 118A and 118B can include integrated inductive charging capabilities to charge one or more of the mobile devices placed therein. The pockets 118A and 118B can also include charging ports to provide wired charging of the mobile devices. The charging ports can include USB and USC ports. The pockets 118A and 118B can be integrated into portions of the side rails 110A and 110B that are easy to reach by the user of the bed system 100, regardless of whether the user is laying down, sitting up, or inclined to another position on the mattress 106.

Moreover, plates 120A and 120B (plate 120B is not depicted in FIG. 1) can be removably attached to a portion of the side rails 110A and 110B, respectively, that is aligned with and above the pockets 118A and 118B, respectively. The plates 120A and 120B can cover holes that are integrated into the side rails 110A and 110B and configured to receive and support side rail accessories. The side rail accessories (not shown in FIG. 1) can include tabletops and handrails, which can improve functionality of the bed system 100 and assist the user of the bed system 100 to get in and out of bed. The plates 120A and 120B can provide an aesthetically pleasing appearance of the foundation 108 when side rail accessories are not attached to the side rails 110A and 110B. When the side rail accessories are attached to either of the side rails 110A and 110B, the corresponding plate 120A or 120B can be removed so that the holes are exposed to receive supports of the side rail accessories.

Figure 2:
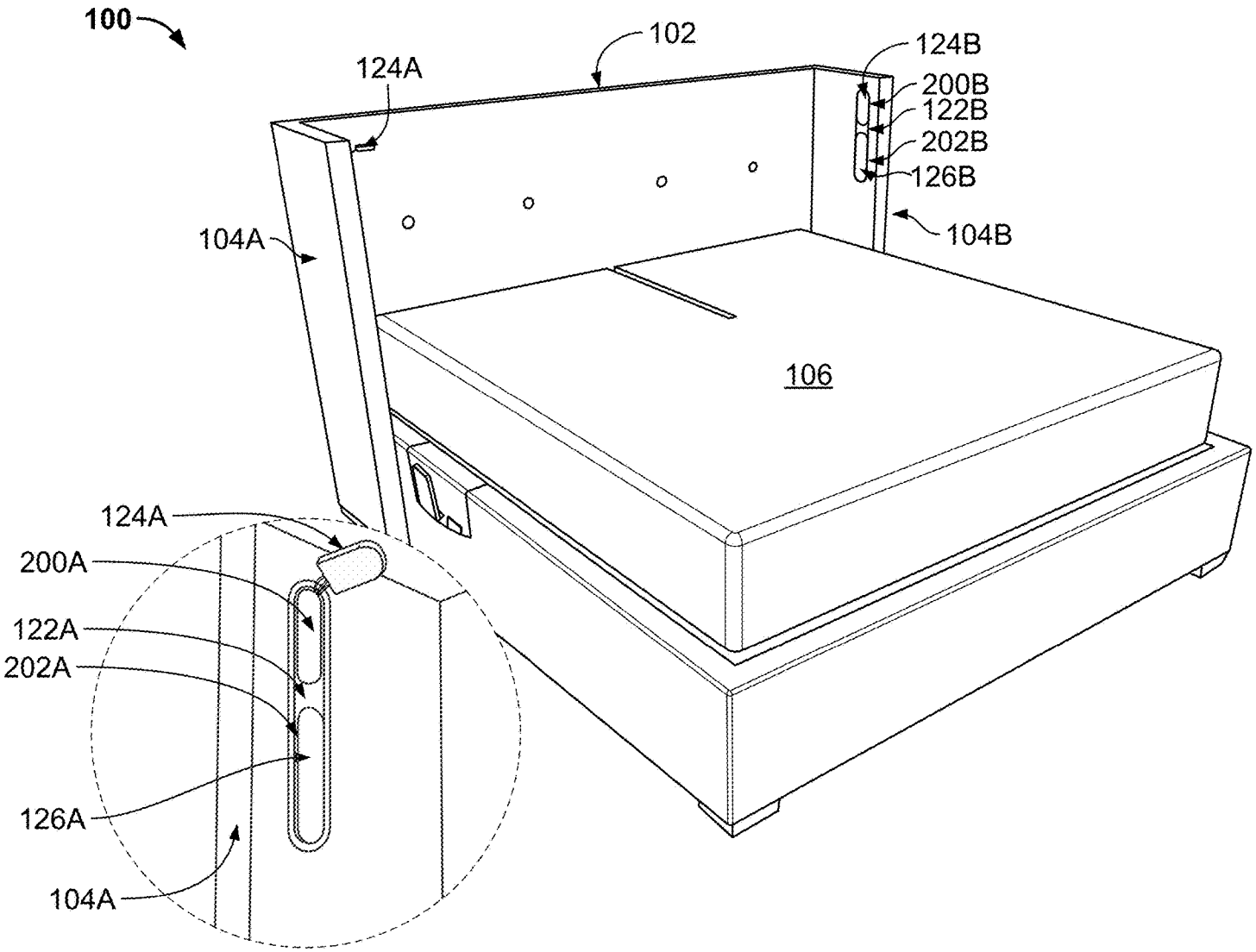
FIG. 2 depicts a reading light extended from a docking portion integrated into a wing of a headboard of the bed system.

FIG. 2 shows the bed system 100, with a reading light 124A extended from a docking portion 122A (e.g., docks, docking structures) integrated into a wing 104A of a headboard 102 of the bed system 100. As described herein, the docking portions 122A and 122B are each recessed into the wings 104A and 104B, respectively. Each of the remotes 126A and 126B can dock into respective recesses 202A and 202B of the docking portions 122A and 122B. An outer periphery of each of the remotes 126A and 126B can be substantially the same as an inner periphery of the recesses 202A and 202B.

In this example, the docking portions 122A and 122B house both the reading lights 124A and 124B and the remotes 126A and 126B, respectively. The reading lights 124A and 124B can dock into respective recesses 200A and 200B of the docking portions 122A and 122B. The recesses 200A and 200B and 202A and 202B can be separate from each other in the respective docking portions 122A and 122B. The recesses 200A and 200B can be aligned with and positioned above the respective recesses 202A and 202B. In some implementations, each of the recesses 200A, 200B, 202A, and 202B can have substantially a same width. In some implementations, each of the recesses 202A and 202B can have lengths that are substantially longer than the recesses 200A and 200B. Moreover, as shown and described throughout this disclosure, the recesses 200A and 200B can be a distance closer to a top portion of the wings 104A and 104B than a distance from the recesses 202A and 202B to the top portions of the wings 104A and 104B.

Referring to the reading lights 124A and 124B, an outer periphery of each of the reading lights 124A and 124B can be substantially the same as (yet slightly smaller than) an inner periphery of the recesses 200A and 200B. Moreover, distal ends of the reading lights 124A and 124B may be oblong-shaped. As shown, the reading light 124B remains in the docking portion 122B integrated into the wing 104B. Both remotes 126A and 126B are also positioned in their respective docking portions 122A and 122B.

The reading light 124A can be moved to extend out from the recess 200A and over a portion of the mattress 106. The reading light 124A can be rotated when extended out from the recess 200A such that light can be provided at a variety of angles that are preferred by a user of the bed system 100. The reading light 124A can include a click-to-open mechanism (e.g., refer to FIG. 5B). To extend the reading light 124A out of the docking portion 122A, the user can click (e.g., tap, press) on a distal end of the reading light 124A, thereby causing the distal end of the reading light 124A to pop out of the docking portion 122A. Clicking on the distal end can engage a spring, thereby causing the reading light 124 to extend out from the recess 200A. As soon as the reading light 124A extends out from the recess 200A, it can be automatically turned on. Similarly, the user may also click on the remote 126A to pop the remote 126A out of the docking portion 122A. The docking portion 122A can be spring-loaded, thereby making it easy and convenient for the user to click on either of the reading light 124A and/or the remote 126A to extend the reading light 124A and/or remove the remote 126A from the docking portion 122A.

In some implementations, to extend the reading light 124A from the docking portion 122A, the user can pull up on the distal end of the reading light 124A. The docking portion 122A can house both the reading light 124A and the remote 126A. Thus, a recess of the docking portion in which the reading light 124A is retained can extend partially below the reading light 124A, thereby creating a gap or area in which the user can access the distal end of the reading light 124A with their hands. As a result, the user can lift up on the distal end of the reading light 124A to extend the reading light 124A from the docking portion 122A. Once the reading light 124A is extended out over the mattress 106, the user can rotate the reading light 124A in a desired direction.

FIGS. 3A-D depict a remote 126 in a docking portion 302 for the bed system described herein. The remote 126 (e.g., refer to remotes 126A and 126B in FIGS. 1-2) can be oblong and curved at opposite ends. The remote 126 can be retained in a docking portion 302 that is integrated into the bed system, as described in reference to FIG. 2. The docking portion 302 can be the same as the docking portions 122A and 122B in FIGS. 1-2. In some implementations, the docking portion 302 can be a docking portion that retains only the remote 126. The docking portion includes recess 202 (e.g., refer to recesses 202A and 202B in FIG. 2) in which the remote 126 can be docked. An outer periphery of the remote 126 can be substantially the same as (yet slightly smaller than) an inner periphery of the recess 202.

As described herein, the remote 126 can be used to control various electrical systems of the bed system described (e.g., an articulation system, a light system, a climate control system, an inflation system, a sound system, etc.) herein. As a result, the remote 126 can include selectable buttons that can be used by the user(s) of the bed system to make adjustments to the bed system. For example, the remote 126 can include selectable options to turn on or off the speakers 112A and 112B, to adjust a volume of the speakers 112A and 112B, and to set a timer for how long audio is played through the speakers 112A and 112B (e.g., 15 minutes, 30 minutes, 45 minutes, 1 hour). The remote 126 can also include selectable options to turn on or off the lights 116A-N, adjust the lights 116A-N to a morning routine (e.g., in which the lights 116A-N output 6,500k of light), adjust the lights 116A-N to an evening routine (e.g., in which the lights 116A-N output 2,700k of light), adjust brightness of the lights 116A-N (e.g., and/or adjust the color of the lights 116A-N from a warm yellow to a white color), and/or set a time for how long the lights 116A-N remain on (e.g., 15 minutes, 30 minutes, 45 minutes, 1 hour). The remote 126 can optionally include one or more additional, fewer, or different control options. For example, the remote 126 can include options to adjust a position of the mattress 106 by tilting head, back, and/or foot portions of the mattress 106 via an articulation system (not shown). The remote 126 can also include options to adjust a temperature and/or pressure of the mattress 106. One or more other control options are possible.

Figure 3A:
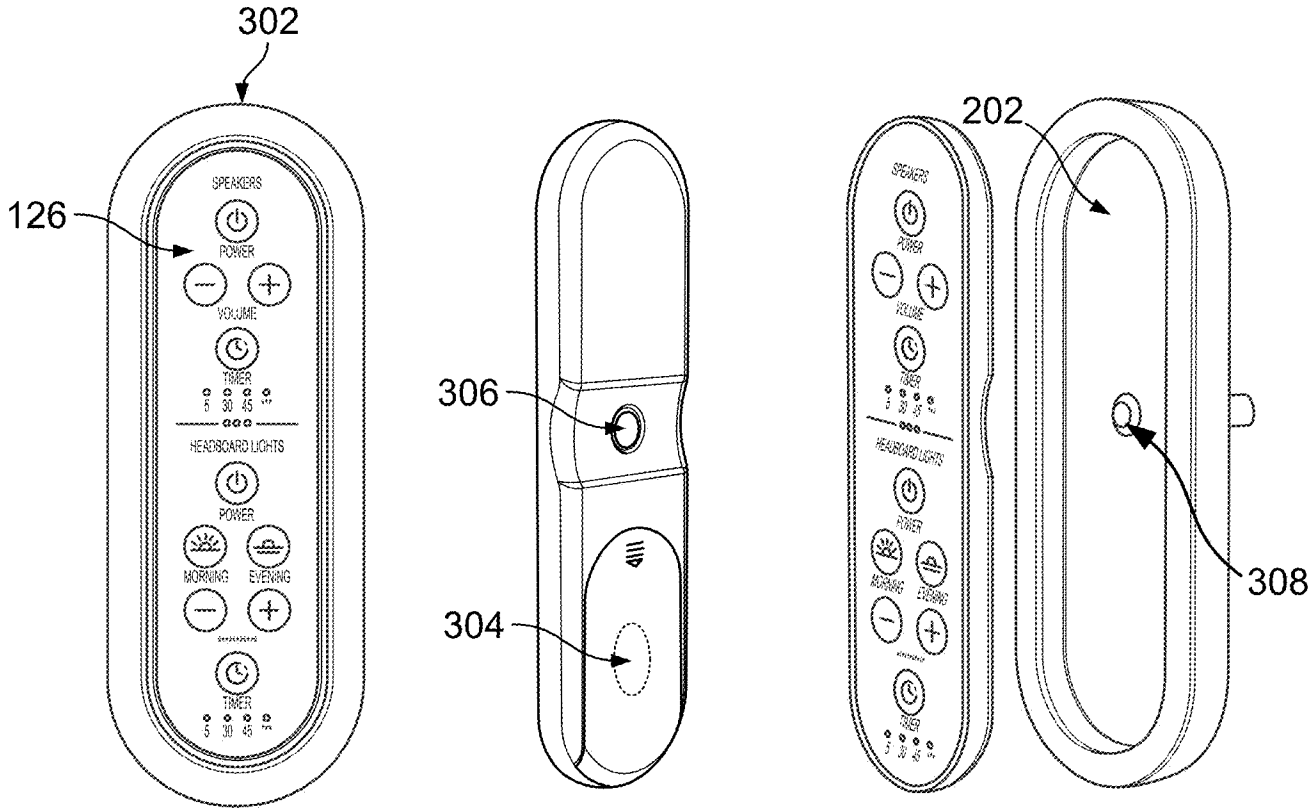
FIGS. 3A-D depict a remote in a docking portion for the bed system described herein.

Referring to FIG. 3A, the remote 126 can include a battery 304. The battery 304 can be a button cell battery, which can be a small single-cell battery shaped as a squat cylinder. The battery 304 can be long-lasting and easily replaceable by the user(s). Using the battery 304 to power the remote 126 can provide the remote 126 with a slim and ergonomic design. This design can also make the remote 126 less costly to manufacture and lightweight. This design also requires a simplified and thin recess 202 for housing the remote 126. After all, neither the remote 126 nor the recess 202 may require a thicker construction to retain wiring and other components to charge the remote 126. In some embodiments the battery 304 can be a primary battery. In some embodiments the battery 304 can be a rechargeable battery.

As described herein, the recess 202 can be spring-loaded. Therefore, to retain the remote 126 in the docking portion 302, the user can click the remote 126 into the recess 202. The user can click the remote 126 into the recess 202 by pressing down on a center of the remote 126. The user can also click down on the center of the remote 126 to pop the remote 126 out of the recess 202. The recess 202 can include a spring at a center of the recess 202 (such as at the location of a magnet 308) so that when the remote 126 is pressed against the spring, the remote 126 can pop in or out of the recess 202. The remote 126 can also include a magnet 306 integrated into a back portion of the remote 126. The recess 202 can include a magnet 308. When the user clicks the remote 126 into the recess 202, the magnets 306 and 308 can be attracted to each other so that the remote 126 is retained within the recess 202.

Figure 3B:
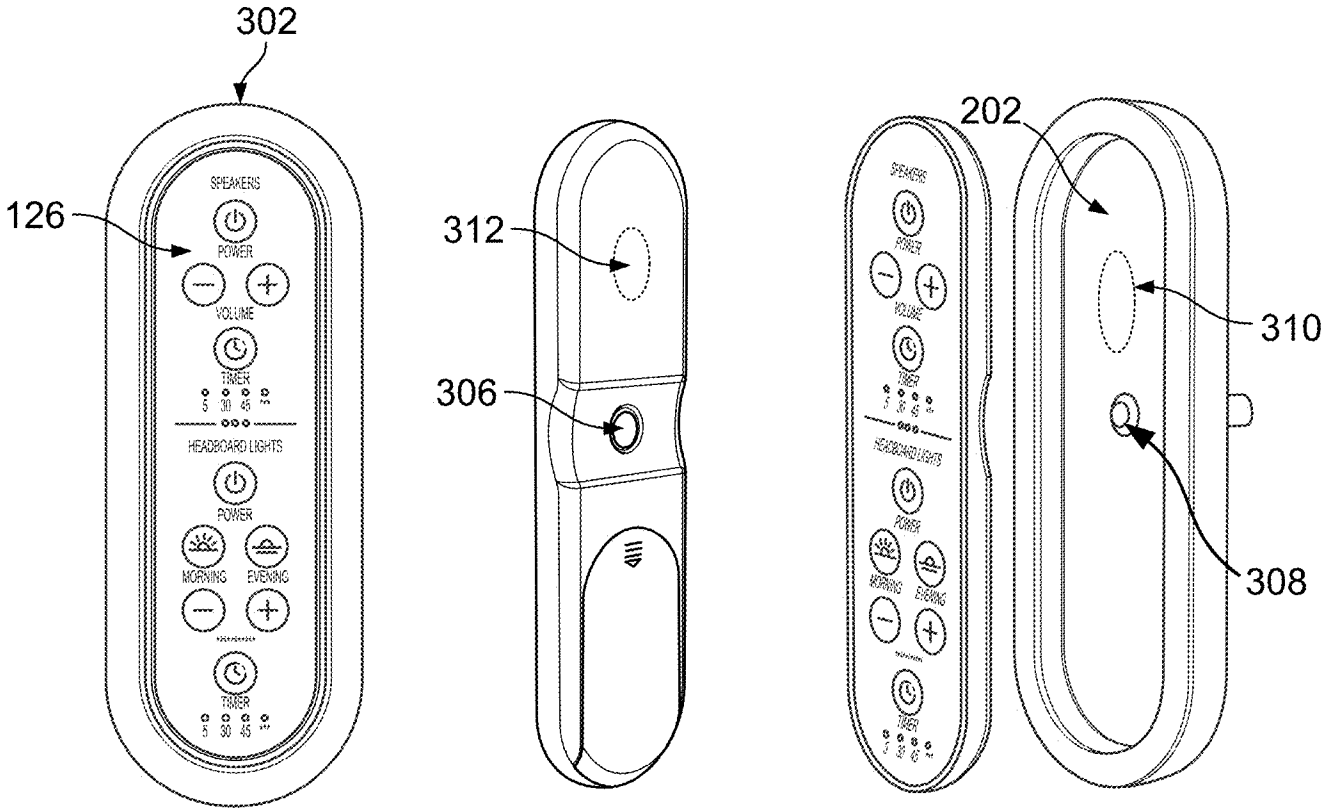

Referring to FIG. 3B, the remote 126 can optionally be wirelessly charged while retained in the recess 202 of the docking portion 302. The remote 126 can include a wireless charging receiver 312 operably coupled to the battery 304 to recharge the battery 304 (suitable for embodiments in which the battery 304 is a rechargeable battery). The recess 202 can include an inductive charger 310. The inductive charger 310 can include components such as a wireless charger and a transmitter. In some implementations, the inductive charger 310 can include wireless charging coils for inductively charging the remote 126.

Figure 3C:
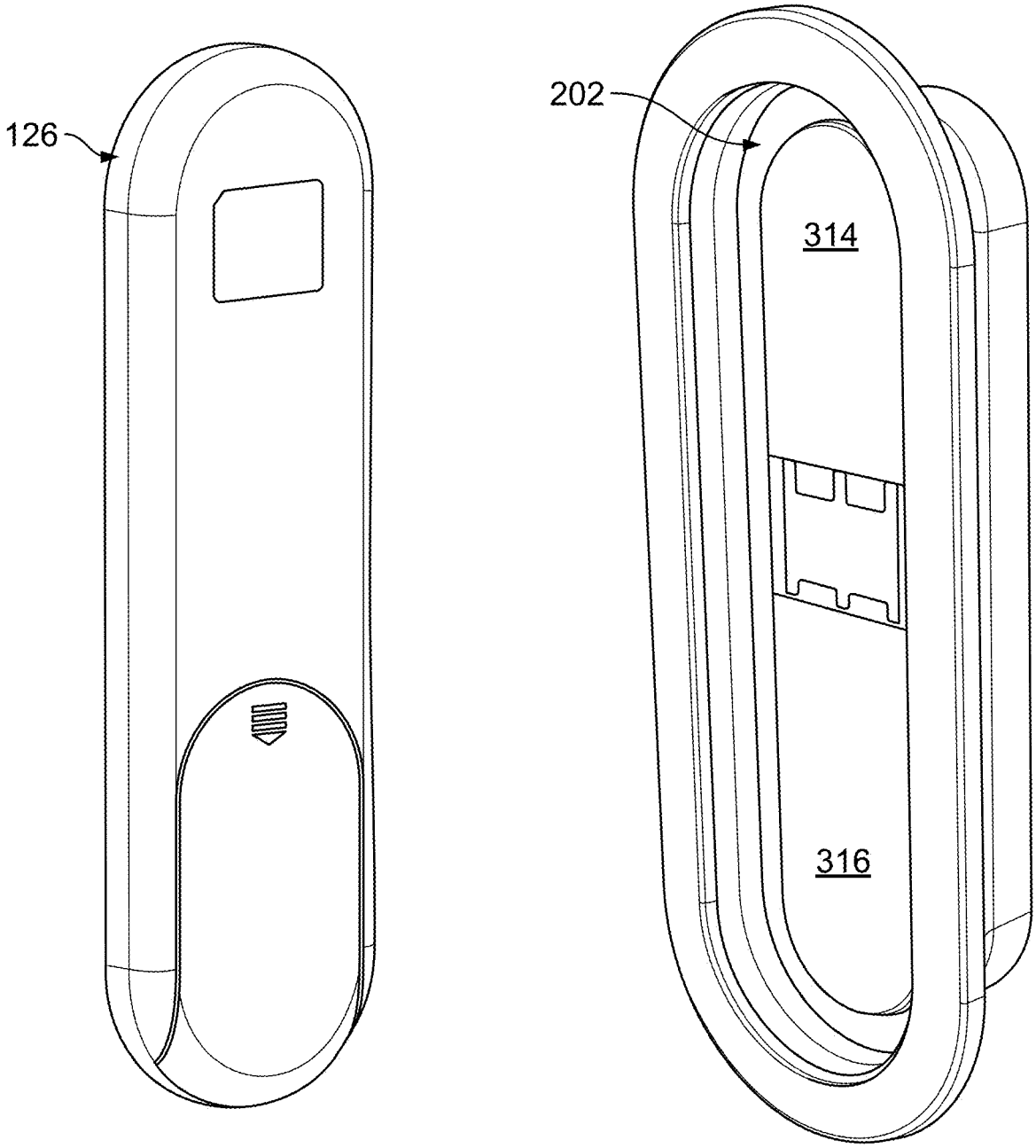

Referring to FIG. 3C, an entire back surface of the recess 202 can be used to click the remote 126 in and out of the recess 202. For example, the recess 202 can include two springs, one integrated into a top portion 314 of the recess 202 and one integrated into a bottom portion 316 of the recess 202. When the user presses down on the remote 126 while in the recess 202, the remote 126 can be ejected evenly from the recess 202.

Figure 3D:
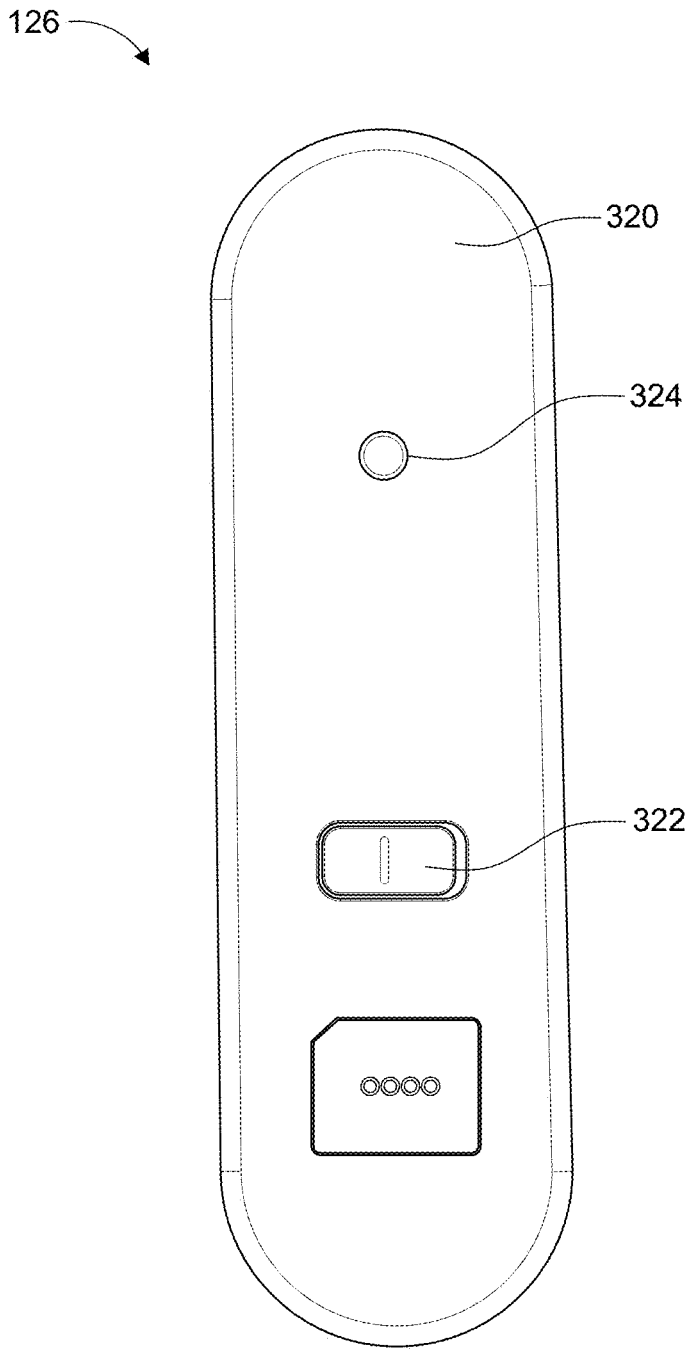

FIG. 3D depicts an example of one embodiment of a back surface 320 of the remote 126 described herein. The back surface 320 includes a switch 322, which can be used to toggle features of the remote 126 for left and right sides of a bed system described herein. For example, when the switch 322 is in a left position, as shown in FIG. 3D, buttons and other controls on a front of the remote 126 can be used to adjust features on the left side of the bed system. When the switch 322 is in a right position, the buttons and other controls on the front of the remote 126 can be used to adjust features on the right side of the bed system. As a result of this design, the same remote 126 can be used to control both sides of the bed system, regardless of which side of the bed system the remote 126 is docked. The back surface 320 of the remote 126 may also include a button 324, which can be used to reset the remote 126. For example, the button 324 can be pressed in some scenarios to reset remote software if one or more bed system components crash or freeze. As an illustrative example, the button 324 can be pressed in a scenario in which a backlight of the remote 126 freezes or gets stuck and/or the remote 126 is unable to pair with one or more control systems of the bed system. In some implementations, for example, pressing the button 324 can cause the remote 126 to power off and/or restart.

Although the remote 126 is described in FIGS. 3A-C as fitting into the docking portion 302, the remote 126 can also fit into recesses of the docking portions 122A and 122B described in reference to at least FIGS. 1 and 2 that are configured to retain both remote and reading light. The docking portions 122A and 122B and/or the docking portion 302 can be modified to a shape and configuration suitable for receiving the remote 126, depending on which embodiment of the remote 126 is used.

Figure 4A:
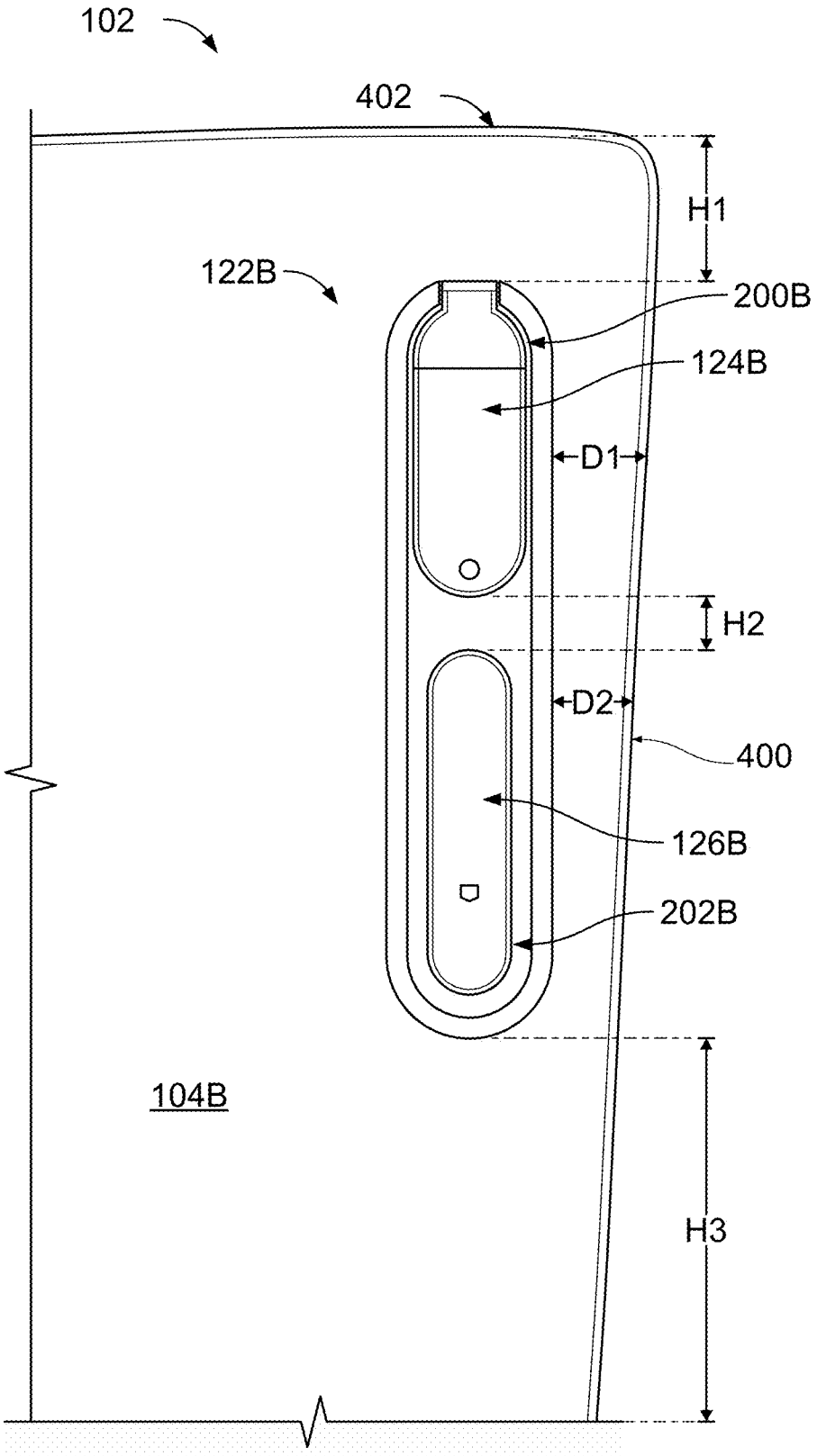
FIGS. 4A-B depict an example docking portion integrated into a wing of a headboard of the bed system.

FIG. 4A depicts an example docking portion 122B integrated into a wing 104B of a headboard 102 of the bed system 100. In this example, the docking portion 122B retains both the reading light 124B and the remote 126B, as described in reference to FIGS. 1-2.

The docking portion 122B can be inset into the wing 104B at a distance closer to a lateral edge 400 of the wing 104B than a front side of the headboard 102 and a height closer to a top portion 402 of the wing 104B than a bottom portion of the wing 104B. More particularly, the docking portion 122B can be inset into the wing 104B at a distance D1 from the lateral edge 400 of the wing 104B. The docking portion 122B can be inset into the wing 104B at a height H1 from the top portion 402 of the wing 104B. D1 can be within a range of 25-80 mm. In some implementations, for example, D1 can be 51 mm. H1 can also be within a range of 25-80 mm. In some implementations, H1 can be 51 mm.

The recess 200B for the reading light 124B can be positioned a height H2 above the recess 202B for the remote 126B. H2 can be within a range of 25-80 mm. For example, H2 can be 51 mm. The recess 202B can be positioned a height H3 above the mattress 106 (not depicted). H3 can vary depending on what type of mattress is used. As an example, H3 can be 262 mm. H3 can also be within a range of 150-300 mm. H3 is beneficial to ensure that the remote 126B and the reading light 124B are accessible by any user regardless of a position of the user in the bed system (e.g., laying down flat, sitting up, etc.). Moreover, in some implementations, a bottom edge of the docking portion 122B can be approximately 592 mm above a side rail of the foundation. The bottom edge of the docking portion 122B can also be a distance within a range of 400-600 mm above the side rail of the foundation.

In implementations where the docking portion 122B retains both the reading light 124B and the remote 126B, each of the reading light 124B and the remote 126B can be extended or removed from the respective recesses 200B and 202B by lifting up on an exposed edge of the reading light 124B and the remote 126B. In some implementations where the recesses 200B and 202B are not integrated into the singular docking portion 122B, each of the recesses 200B and 202B can include click-to-remove or click-to-open features. For example, as described in reference to FIGS. 3A-B, the user can press down on the reading light 124B and/or the remote 126B to pop the reading light 124B and/or the remote 126B out of the respective recess 200B and 202B.

Although the recesses 200B and 202B as illustrated are integrated into the singular docking portion 122B, the recess 200B can be separate from the recess 202B. The recess 200B can be aligned with and positioned above the recess 202B. Moreover, the recess 200B can have substantially a same width as the recess 202B. The recess 200B can be a same distance D1 from the lateral edge 400 of the wing 104B as the recess 202B from the lateral edge 400 of the wing 104B. As shown and described herein, the recesses 200B and 202B can therefore be closer to the lateral edge 400 of the wing 104B than an opposite lateral edge of the wing 104B (not depicted).

Figure 4B:
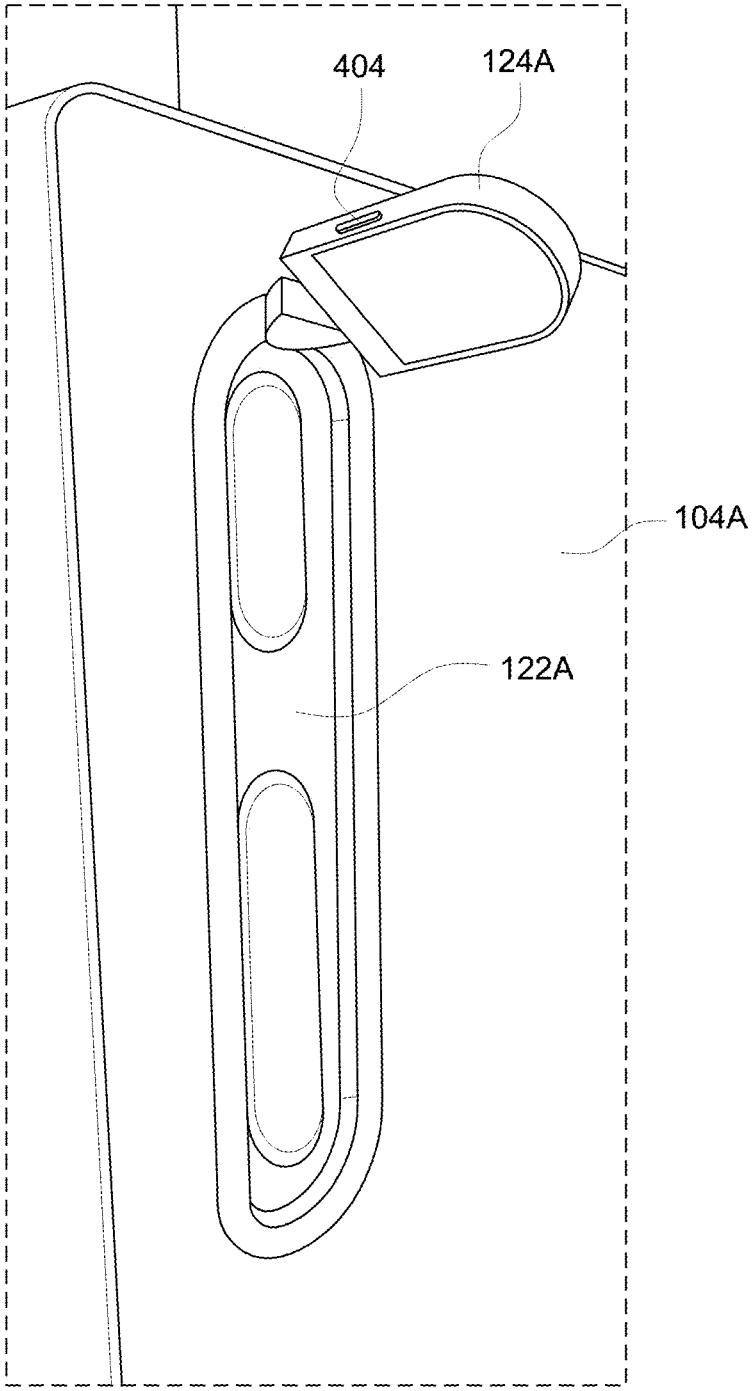

FIG. 4B depicts an example of the docking portion 122A integrated into the wing 104A described in at least FIGS. 1 and 2. As described above in reference to FIG. 4A, the docking portion 122A can be configured to retain both the reading light 124A and the remote 126A (not depicted). In some implementations, the docking portion 122A is removable from the wing 104A. As a result, when the light 124A or any other component of the docking portion 122A requires maintenance or repairs, the docking portion 122A can simply be removed from the wing 104A rather than replacing the entire wing 104A with a new wing. This design can beneficially reduce costs and time of maintenance and repairs. Furthermore, the reading light 124A can include at least one button 404 for turning the light on and off, adjusting a brightness/intensity of the light, and/or changing a color of the light. The features described in FIG. 4B also can apply to the docking portion 122B, the light 124B, and the wing 104B described throughout this disclosure.

Figure 5A:
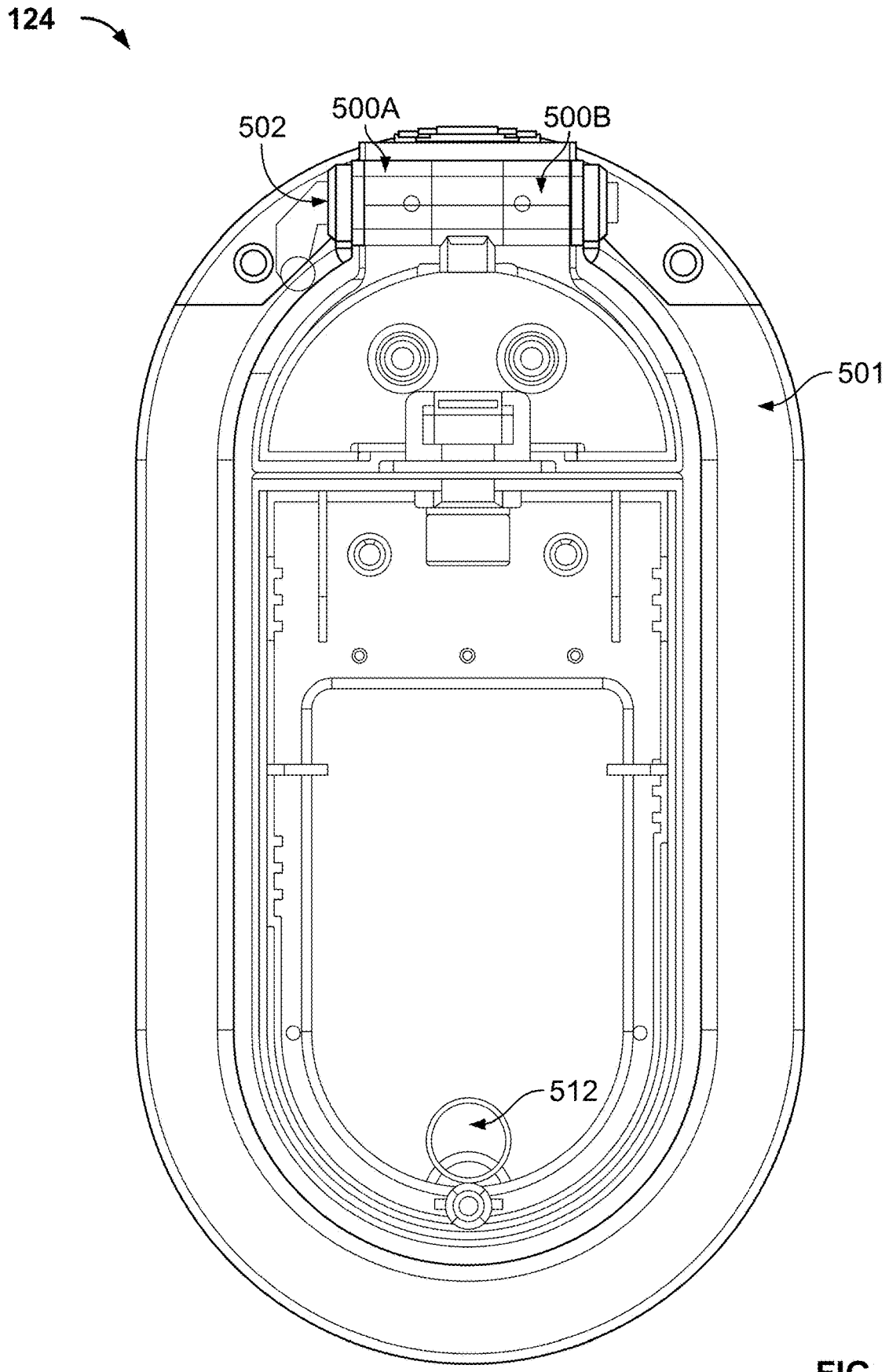
FIGS. 5A-B depict a reading light and docking portion configuration.
Figure 5B:
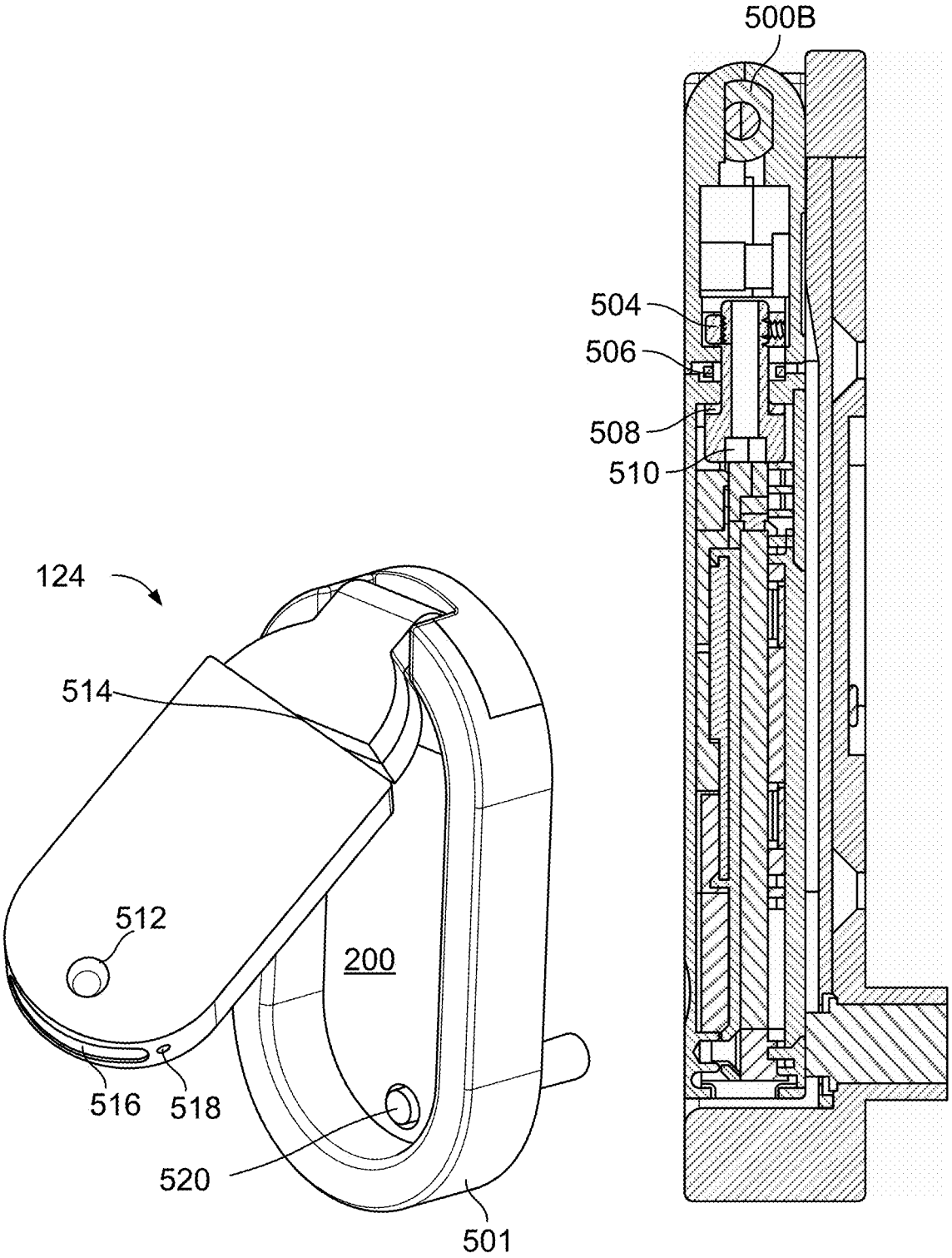

FIGS. 5A-B depict a reading light 124 and docking portion 501 configuration. The reading light 124 (e.g., refer to reading lights 124A and 124B described throughout this disclosure) can extend from the docking portion 501 (e.g., refer to the docking portions 122A and 122B described throughout this disclosure) to provide lighting over a portion of a mattress of the bed system described herein. The docking portion 501 can be the same as the docking portions 122A and 122B in FIGS. 1-2. In some implementations, the docking portion 501 can be a docking portion that retains only the reading light 124. The docking portion 501 includes recess 200 (e.g., refer to recesses 200A and 200B described throughout this disclosure) in which the reading light 124 can be docked.

Referring to FIG. 5A, the reading light 124 is in a docked configuration in the docking portion 501. In other words, the reading light 124 is not extended out from the docking portion 501 to provide lighting to the user of the bed system described herein. In FIG. 5B, the reading light 124 is extended from the docking portion 501 into an extended configuration. In the extended configuration, the reading light 124 can rotate around a pivot point 514. The reading light 124 can rotate approximately 170 degrees in either direction around the pivot point 514. By rotating the reading light 124 around the pivot point 514, the user can customize an angle at which light is provided on their side of the bed system, regardless of an activity of the user (e.g., reading, working, watching TV, etc.) and/or a position of the user (e.g., laying down flat, sitting up, in one or more other positions from adjusting the bed system).

Referring to both FIGS. 5A-B, the reading light 124 can have a light guide panel to provide even dispersion of light when the reading light 124 is used. The reading light 124 can include a button 518, which can be pressed by the user to adjust one or more settings of the reading light 124. For example, the button 518 can be pressed once to turn on the reading light 124 and output a white light. The white light can be a natural light that is comfortable, cozy, and useful for reading in bed. The button 518 can be pressed a second time to switch from outputting the white light to outputting a red light. The red light can be warm. The button 518 can be pressed a third time to turn off the reading light 124.

The reading light 124 includes an indented portion 512 near a distal end of the reading light 124. By pressing down on the indented portion 512, the user can pop the reading light out from the recess 200 and into the extended configuration. Once the reading light 124 is in the extended configuration, the reading light 124 can be automatically activated and turned on to output white light. Once in the extended configuration, the user can also press down on the indented portion 512 to push the reading light 124 back into the recess 200 to be retained therein in the docked configuration. Accordingly, a back portion 520 of the recess 200 may be spring-loaded to provide this quick and easy functionality of the reading light 124. In some implementations, the back portion 520 may also include a magnet for retaining the reading light 124 when the reading light 124 is inside the recess 200 and not in an extended configuration.

The reading light 124 includes hinges 500A and 500B, which allow the reading light to extend out of the recess 200 such that, in the extended configuration, the reading light 124 may be perpendicular or otherwise not parallel with and adjacent to the recess 200 of the docking portion 501. The hinges 500A and 500B can be hollow damping hinges. The hinge 500A can include a wire cavity 502, which can provide space for wiring to pass through to electrical components of the reading light 124. The wires can connect the electrical components of the reading light 124 with at least one of a controller and/or a power supply of the bed system described herein (not depicted) so that the reading light 124 can be controlled/operated by a user device and/or a remote (e.g., the remotes 126A and 126B). The hinges 500A and 500B can be in close proximity to each other and function with damping as well as allowing for wiring to pass through.

The reading light 124 can also include a slider bar 516 along an edge of the distal end of the reading light 124. The slider bar 516 can be a black touch sensitive slider bar, which can be used by the user to adjust brightness of the reading light 124. The slider bar 516 can include icons on left and right sides of the slider bar 516 that indicate which direction to slide to brighten or dim the reading light 124. For example, sliding left to right along the slider bar 516 can cause a brightness of the reading light 124 to progressively increase and sliding right to left along the slider bar 516 can cause a brightness of the reading light 124 to progressively decrease/diminish.

The reading light 124 can also include a locking nut 504, a friction ring 506, a copper gasket 508, and a locking bolt 510. In combination, the components 504, 506, 508, and 510 allow for the reading light 124 to remain within the extended configuration at the user-desired rotation around the pivot point 514. The components 504, 506, 508, and 510 also allow for a custom hinge configuration for the reading light 124. For example, the friction ring 506 and the gasket 508 help to give a damping effect, which allows the reading light 124 to remain in a position that the user puts it in.

The reading light 124 can include a compact configuration of electrical and mechanical components. This compact configuration can be beneficial to provide a slim and ergonomic design for the reading light 124. Despite having this compact configuration, wires for powering and controlling the reading light 124 can be efficiently wired through the cavity 502 and to the various electrical components of the reading light 124. In some implementations, a click to open mechanism provided by an indented portion 512 may not be part of the reading light 124. Instead, as described above, the reading light 124 can be used by access and lifting up on a bottom edge of the reading light 124. A click plunger of the reading light 124 can contain a magnet to help keep the light in a secure closed position when clicked in.

While this specification contains many specific implementation details, these should not be construed as limitations on the scope of the disclosed technology or of what may be claimed, but rather as descriptions of features that may be specific to particular embodiments of particular disclosed technologies. For example, in some embodiments, the same of headboards, docking stations, remotes, reading lights, lights, foundations, mattresses, or other features can be varied as suitable for the application. Indeed, in some alternative embodiments, the bed system can include a remote for controlling the bed system where the remote includes a wireless charging receiver that can be positioned on a portion of the bed system with an inductive charger, but without using the same recess 202 as described herein (or possibly without requiring any recess). In further alternative embodiments, the bed system can include a remote with a remote docking recess without requiring either the illustrated lights or any lights. Certain features that are described in this specification in the context of separate embodiments can also be implemented in combination in a single embodiment in part or in whole. Conversely, various features that are described in the context of a single embodiment can also be implemented in multiple embodiments separately or in any suitable subcombination. Moreover, although features may be described herein as acting in certain combinations and/or initially claimed as such, one or more features from a claimed combination can in some cases be excised from the combination, and the claimed combination may be directed to a subcombination or variation of a subcombination. Similarly, while operations may be described in a particular order, this should not be understood as requiring that such operations be performed in the particular order or in sequential order, or that all operations be performed, to achieve desirable results. Particular embodiments of the subject matter have been described. Other embodiments are within the scope of the following claims.

What is claimed is:

1. A system comprising:

a bed structure having a remote docking portion;

a remote configured to dock into a first recess of the remote docking portion; and a light integrated into a second recess of the remote docking portion, the light being configured to (i) extend out from the second recess and (ii) rotate when extended out from the second recess, wherein the second recess is positioned above and is aligned with the first recess for the remote, and wherein the bed structure is a headboard, the headboard comprising first and second wings that extend a distance from opposite lateral edges of the headboard.

2. The system of claim 1, wherein the remote docking portion is inset into at least one of the first and second wings at a distance of 25-80 mm from a lateral edge of the at least one of the first and second wings and a height of 25-80 mm from a top portion of the at least one of the first and second wings.

3. The system of claim 1, wherein the remote docking portion includes a wireless charger and a transmitter for inductively charging the remote when the remote is docked into the first recess of the remote docking portion.

4. The system of claim 1, wherein:

the remote includes a first magnet integrated into a back portion of the remote, the first recess of the remote docking portion includes a second magnet, and docking the remote into the first recess of the remote docking portion causes the first magnet to be attracted to the second magnet to maintain the remote in the first recess of the remote docking portion.

5. The system of claim 1, wherein the second recess has a same width as the first recess for the remote.

6. The system of claim 1, wherein the light comprises a button along an edge of the light to turn the light on and off.

7. The system of claim 1, wherein a distal end of the light is oblong-shaped and an outer periphery of the light is substantially the same as an inner periphery of the second recess.

8. The system of claim 1, wherein an outer periphery of the remote is substantially the same as an inner periphery of the first recess of the remote docking portion.

9. A system comprising:

a bed structure comprising a headboard, the headboard comprising first and second wings having distal wing edges that extend distally a distance from opposite lateral headboard edges of the headboard;

a remote docking portion positioned in an inner side wall of one or both of the first and second wings, the remote docking portion inset into an inner side wall of at least one of the first and second wings at a distance closer to the distal wing edge of the at least one of the first and second wings than a front side of the headboard and a height closer to a top portion of the at least one of the first and second wings than a bottom portion of the at least one of the first and second wings; and a remote configured to dock into a first recess of the remote docking portion.

10. The system of claim 9, further comprising a light integrated into a second recess in the remote docking portion, the light being configured to (i) extend out from the second recess and (ii) rotate when extended out from the second recess.

11. A bed system comprising:

a docking structure defining a first recess and a second recess;

a remote configured to dock into the first recess of the docking structure; and a light integrated into the second recess of the docking structure, wherein the light is configured to move between a docked configuration and an extended configuration, wherein the light extends out from the second recess of the docking structure in the extended configuration.

12. The bed system of claim 11, wherein the light is rotatable when in the extended configuration.

13. The bed system of claim 11, wherein the second recess is aligned with and positioned above the first recess.

14. The bed system of claim 11, wherein:

the first recess has a same width as the second recess, and the first recess has a length that is substantially longer than the second recess.

15. The bed system of claim 11, wherein:

the bed system comprises a headboard structure, the second recess is a distance closer to a top portion of the headboard structure than a distance from the first recess to the top portion of the headboard structure, the first recess is a same distance from a lateral edge of the headboard structure as the second recess from the lateral edge of the headboard structure, and the first and second recesses are closer to the lateral edge of the headboard structure than an opposite lateral edge of the headboard structure.

16. The bed system of claim 11, wherein the remote is oblong and curved at opposite ends.

17. The bed system of claim 11, wherein:

a distal end of the light is oblong-shaped, and the light includes at least one button along a lateral side of the light for turning the light on and off.

18. A bed system comprising:

a headboard structure including:

a main headboard portion;

a left wing attached to a first lateral edge of the main headboard portion; and a right wing attached to a second lateral edge of the main headboard portion;

a first docking structure defining a first recess and a second recess, wherein the first docking structure is integrated into the left wing of the headboard structure;

a second docking structure defining a first recess and a second recess, wherein the second docking structure is integrated into the right wing of the headboard structure;

a first remote configured to dock into the first recess of the first docking structure;

a second remote configured to dock into the first recess of the second docking structure;

a first light integrated into the second recess of the first docking structure; and a second light integrated into the second recess of the second docking structure, wherein the first and second lights are each configured to move between a docked configuration and an extended configuration.

19. The bed system of claim 18, wherein:

the first docking structure is removable from the left wing and replaceable; and the second docking structure is removable from the right wing and replaceable.

20. The bed system of claim 18, wherein the second recess is positioned above and is aligned with the first recess.

* * * * *